US005836328A

United States Patent [19]

Lee

[11] Patent Number: 5,836,328

[45] Date of Patent: Nov. 17, 1998

[54] GARDEN UMBRELLA WITH UPPER AND LOWER SUPPORT RIBS

[76] Inventor: Henry Lee, 10F-1, No. 303, Sec. 3, Chung-Hsiao E. Rd., Taipei City, Taiwan

[21] Appl. No.: 47,668

[22] Filed: Mar. 25, 1998

[51] Int. Cl.[6] ..... A45B 19/12

[52] U.S. Cl. ..... 135/25.2; 135/29; 135/31

[58] Field of Search ..... 135/25.2, 25.3, 135/25.31, 25.32, 28, 29, 31, 32

[56] References Cited

U.S. PATENT DOCUMENTS

| | | |
|---|---|---|
| 829,858 | 8/1906 | Eaton . |
| 1,206,667 | 11/1916 | Carlson . |
| 1,824,192 | 9/1931 | Bouma . |
| 1,839,309 | 1/1932 | Gundel . |
| 3,853,136 | 12/1974 | Schwartzenberg . |
| 5,329,953 | 7/1994 | Becher . |
| 5,472,006 | 12/1995 | Kuo et al. . |
| 5,482,069 | 1/1996 | Lee . |

*Primary Examiner*—Lanna Mai
*Attorney, Agent, or Firm*—Morgan & Finnegan LLP

[57] ABSTRACT

A garden umbrella includes upper and lower support ribs, a runner sleeved slidably on a pole, stretchers, and connecting rods pivotally interconnecting upper and lower support ribs. Each stretcher has one end pivotally attached to a runner and an opposite end pivotally attached to the corresponding upper and lower support ribs. As such, the pivotal attachments described above constitute a pantograph structure, thereby facilitating convenient stretching and collapsing operations.

5 Claims, 4 Drawing Sheets

GARDEN UMBRELLA WITH UPPER AND LOWER SUPPORT RIBS

BACKGROUND OF THE INVENTION

1. Field of the Invention

This invention relates to a garden umbrella, more particularly to a garden umbrella with upper and lower support ribs for strengthening its construction.

2. Description of the Related Art

Referring to FIG. 1, a conventional garden umbrella is shown to include a pole 10 with a top hub 12 which provides a pivot connection for upper support ribs 15, and upper and lower runners 13, 14 which are sleeved slidably on the pole 10 and which provide a pivot connection for lower support ribs 16 and stretchers 17, respectively. The stretchers 17 are attached pivotally to the lower support ribs 16. A plurality of connecting rods 18 interconnect the upper and lower support ribs 15, 16. During stretching operation, the stretchers 17 are moved upward by upward movement of the lower runner 14 to stretch the lower support ribs 16. Consequently, the upper support ribs 15 are actuated to spread by the connecting rods 18.

Because the upper support ribs 15 are only actuated by the connecting rods 18 and are not directly attached to the stretchers 17, it requires much effort to spread the upper and lower support ribs 15, 16. Furthermore, the construction of the conventional garden umbrella requires assembly in a precise manner, thereby causing inconvenience, and the additional runner 13 results in a higher manufacturing cost.

SUMMARY OF THE INVENTION

The object of the present invention is to provide a garden umbrella which is easier to unfold or collapse and which is easy to fabricate at a relatively low manufacturing cost.

According to this invention, a garden umbrella includes upper and lower support ribs, a runner which sleeved slidably on a pole, stretchers, and connecting rods which pivotally interconnect the upper and lower support ribs. Each stretcher has one end pivotally attached to a runner and an opposite end pivotally attached to the corresponding upper and lower support ribs. The pivotal attachments described above form a pantograph structure, which facilitates the stretching and collapsing operations.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENTS

Figure 1:
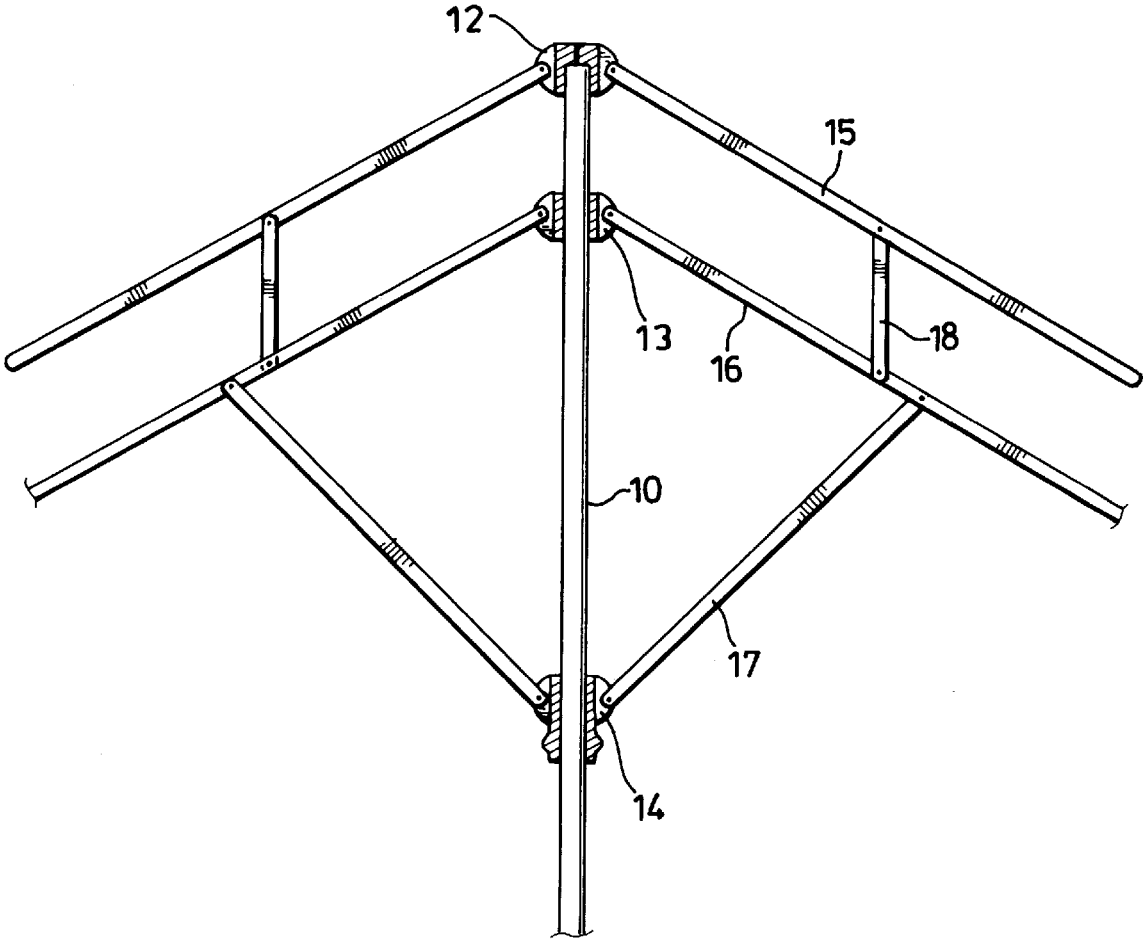
FIG. 1 PRIOR ART
FIG. 1 shows a conventional garden umbrella with upper and lower support ribs.
Figure 2:
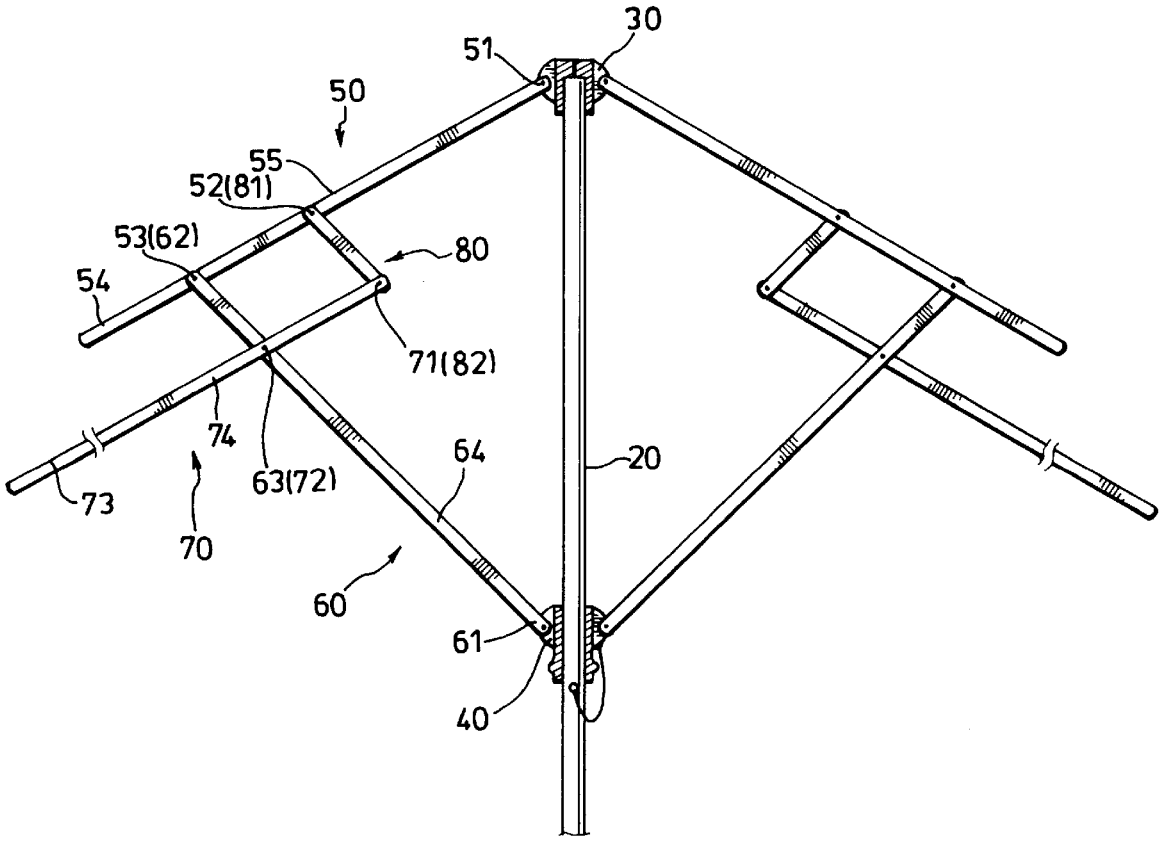
FIG. 2 is a schematic view of a preferred embodiment of a garden umbrella according to this invention in a stretched position.

Referring to FIG. 2, a preferred embodiment of a garden umbrella according to the present invention is shown to comprise an upright pole 20, a rib holder 30 secured on an upper end of the pole 20, a runner 40 sleeved slidably on the pole 20, a plurality of upper and lower support ribs 50, 70, a plurality of stretchers 60, and a plurality of connecting rods 80.

Each upper support rib 50 has a first proximate end 51 which is pivotally attached to the rib holder 30, a first distal end 54, and a first intermediate portion 55 between the first proximate and distal ends 51, 54. The first intermediate portion 55 is formed with first and second connecting holes 52, 53.

Each stretcher 60 has second proximate and distal ends 61, 62 which are pivotally attached to the runner 40 and the first intermediate portion 55 of the upper support ribs 50 at the second connecting hole 53. A second intermediate portion 64 of the stretcher 60 is formed with an engaging hole 63.

Each lower support rib 70 has a third proximate end 71 relative to the rib holder 30, a third distal end 73, and a third intermediate portion 74 with an engaging hole 72 for attaching pivotally to the engaging hole 63.

Each connecting rod 80 has an upper end 81 with a hole for pivotal attachment to the first connecting hole 52 of the first intermediate portion 55, and a lower end 82 for pivotal attachment to the third proximate end 71 of the lower support rib 70.

Preferably, the connecting rod 80 is parallel to the corresponding stretcher 60. The upper support rib 50 is parallel to the corresponding lower support rib 70. As such, the pivotal attachments between the second distal end 62 and the first intermediate portion 55, between the second intermediate portion 64 and the third intermediate portion 74, between the upper end 81 and the first intermediate portion 55, and between the lower end 82 and the third proximate end 71 form a pantograph structure.

In use, when the runner 40 is moved upward by manual force to stretch the umbrella, the stretchers 60 are moved to actuate the upper and lower support ribs 50, 70. By virtue of the pantograph structure, the umbrella can be stretched conveniently.

Figure 3:
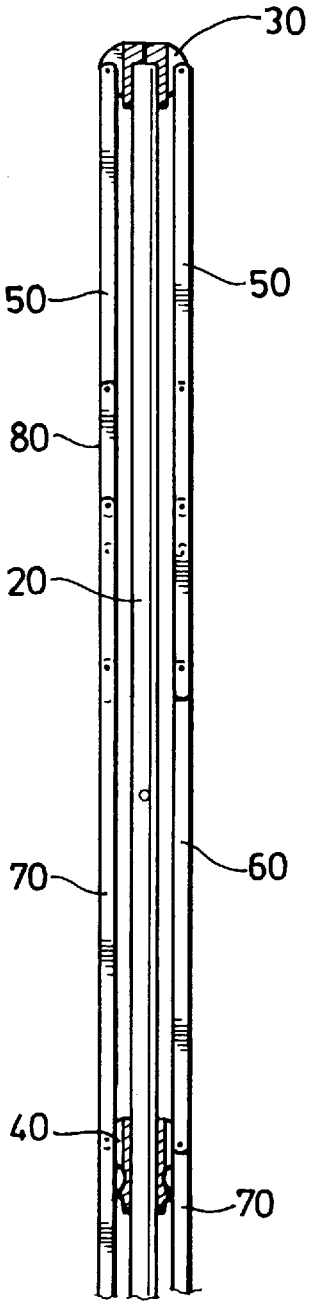
FIG. 3 is a schematic view of the garden umbrella of the preferred embodiment in a collapsed position.

Referring to FIG. 3, the garden umbrella is shown in a collapsed position. Note that the stretchers 60 and the connecting rods 80 are in alignment because the connecting rods 80 are located along the upper support ribs 50 and above the pivot attachment between the first intermediate portion 55 and the second distal end 62, thereby providing a compact size of the umbrella for storage or transport.

Compared to the conventional umbrella, there is no need to provide an additional runner according to the garden umbrella of the present invention, thereby decreasing the assembly cost and time. In addition, the stretchers 60 are directly attached to the upper and lower support ribs 50, 70, resulting in a pantograph structure which facilitates stretching and collapsing operations of the umbrella.

Figure 4:
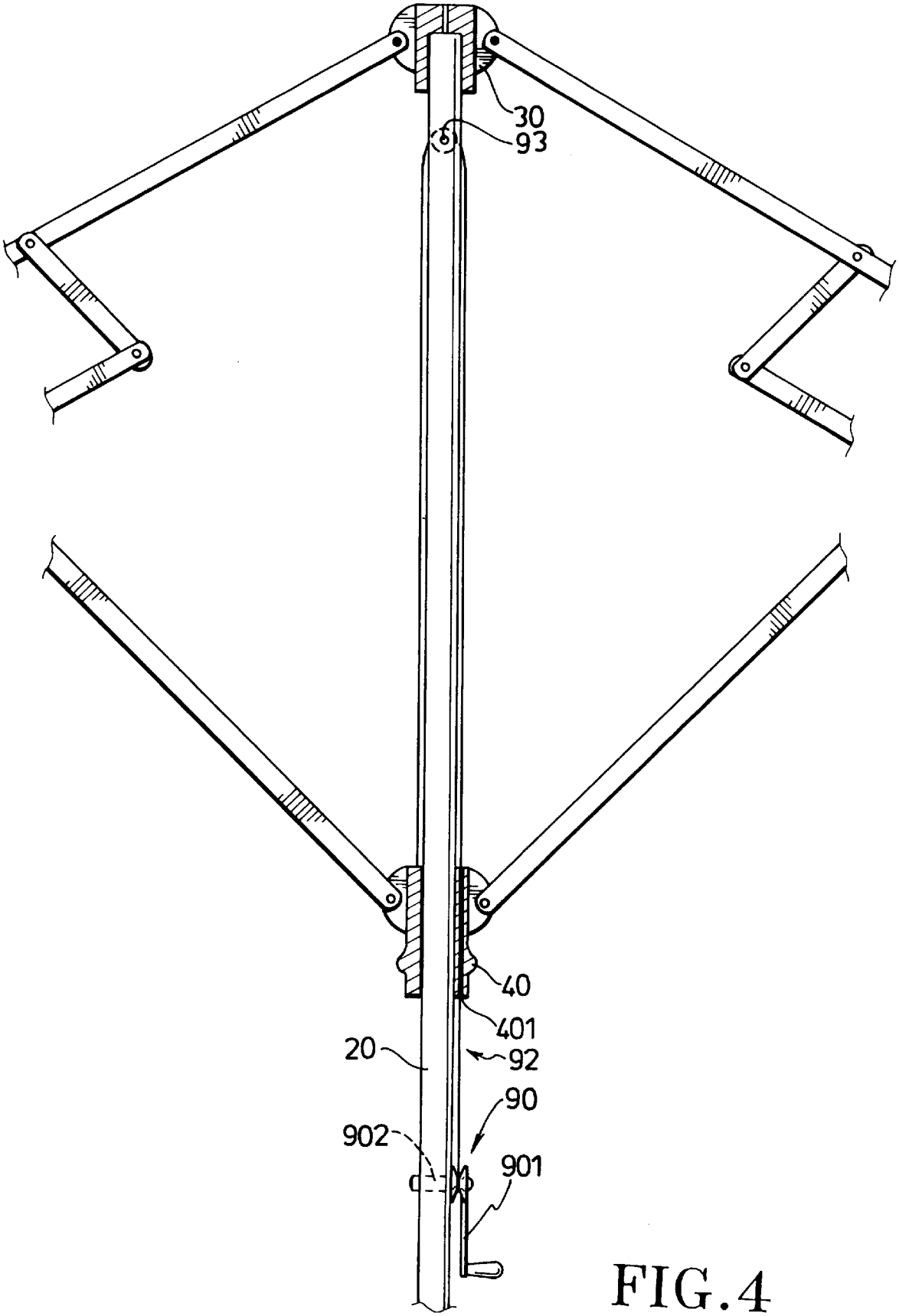
FIG. 4 is a schematic view of another preferred embodiment of the garden umbrella according to this invention.

Referring to FIG. 4, another preferred embodiment of the garden umbrella is shown to further include a spool 90 with a drive shaft 902 mounted rotatably and transversely on the pole 20 below the runner 40. A crank member 901 is provided on the drive shaft 902 for facilitating the rotation of the drive shaft 902. A pulley 93 is mounted rotatably in the pole 20 adjacent to the rib holder 30. A rope 92 is wound around the pulley 93 and has one end fixed to the runner 40 at one side of the pole 20 opposite to the winding handle 901 and the other end extending and passing through and out of a through hole 401 formed in the runner 40 at the other side of the pole 20 to be secured to the drive shaft 902. As such, the rope 92 can be wound via the pulley 93 by turning the crank member 901 so that the runner 40 is lifted along the pole 20, thereby facilitating the stretching of the garden umbrella.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A garden umbrella comprising:

an upright pole having a top end which is provided with a rib holder;

a plurality of upper support ribs, each of which has a first proximate end pivotally attached to said rib holder, a first distal end, and a first intermediate portion between said first proximate end and said first distal end;

a runner slidably sleeved on said pole;

a plurality of stretchers, each of which has a second proximate end pivotally attached to said runner, a second distal end pivotally attached to said first intermediate portion adjacent to said first distal end of the corresponding one of said first support ribs, and a second intermediate portion between said second proximate end and said second distal end;

a plurality of lower support ribs, each of which has a third proximate end relative to said rib holder, a third distal end, and a third intermediate portion between said third proximate end and said third distal end, said third intermediate portion being pivotally attached to said second intermediate portion of the corresponding one of said stretchers; and a plurality of connecting rods, each of which has an upper end pivotally attached to said first intermediate portion of the corresponding one of said upper support ribs adjacent to said first proximate end, and a lower end pivotally attached to said third proximate end of the corresponding one of said lower support ribs.

2. The garden umbrella as claimed in claim 1, wherein each of said connecting rods is substantially parallel to the corresponding one of said stretchers.

3. The garden umbrella as claimed in claim 1, wherein each of said upper support ribs is parallel to the corresponding one of said lower support ribs.

4. The garden umbrella as claimed in claim 1, wherein said pivotal attachments between said second distal end and said first intermediate end, between said second intermediate portion and said third intermediate portion, between said upper end and said first intermediate portion, and between said lower end and said third proximate end constitute a pantograph structure.

5. The garden umbrella as claimed in claim 1, further comprising a drive shaft mounted rotatably and transversely on said pole below said runner, a pulley mounted rotatably on said pole adjacent to said top end, and a rope wound around said pulley and having one end fixed to said runner at one side of said pole and an opposite end passing through said runner at an opposite side of said pole to be secured to said drive shaft, whereby said runner is lifted along said pole when said drive shaft is rotated.

* * * * *